United States Patent [19]

Rainville

[11] Patent Number: 4,582,244

[45] Date of Patent: Apr. 15, 1986

[54] CURVED CORE SANDWICH STRUCTURE FORMING METHOD

[75] Inventor: Gilles Rainville, Northridge, Calif.

[73] Assignee: Rockwell International Corporation, El Segundo, Calif.

[21] Appl. No.: 606,491

[22] Filed: May 3, 1984

[51] Int. Cl.[4] ..... B23K 31/02

[52] U.S. Cl. ..... 228/118; 228/157

[58] Field of Search ..... 228/118, 157; 156/197; 29/157.3 D

[56] References Cited

U.S. PATENT DOCUMENTS 4,361,262 11/1982 Israeli ..... 156/197

*Primary Examiner*—Nicholas P. Godici

*Assistant Examiner*—G. M. Reid

*Attorney, Agent, or Firm*—Charles T. Silberberg

[57] ABSTRACT

The invention involves a novel method for forming sine wave I-beams, and other sandwich structures having a curved core. The core pieces are flat prior to forming. The sandwich structure consists of two face pieces and two core pieces, wherein the core pieces are similar in shape to each other. The pieces are placed in a stack. Each core piece has two lip portions. The lip portions are extensions of the core pieces, and have a curved shape prior to forming that does not change during forming. The core pieces are joined to each other along one lip portion, and each core piece is joined to one face piece along the other lip portion. The shape of the curved core sheets and the shape of the lip portions determine the curvature of the formed core. The core pieces are unfolded and expanded in forming dies at elevated temperatures and pressures to form the desired structure.

8 Claims, 7 Drawing Figures

CURVED CORE SANDWICH STRUCTURE FORMING METHOD

BACKGROUND OF THE INVENTION

The invention relates to sandwich structures having curved core and a forming process wherein the structure is formed from flat pieces.

Sandwich structures are characterized by core structure positioned between two face sheets. As used herein, the term "sandwich structures" includes beams. Sandwich structures have attained widespread use in advanced aircraft, particularly in wings, wall panels, doors, webs of beams, and the like. These lightweight structures can withstand large normal loads. Considerable research and development has resulted in novel tooling and production methods to create these unique structures. Many of the materials used have superplastic properties.

"Superplasticity" refers to the property of certain materials, particularly metal alloys, to exhibit unusually high tensile elongations with reduced tendency towards necking. The elongations occur when the microstructure is properly heated to within a predetermined temperature range and when the structure is deformed within a predetermined stress range. Many materials may be used; including but not limited to aluminum, titanium, copper, and their respective alloys, as well as plastics, composites and steel. The titanium alloy, Ti-6Al-4V, has generally been preferred in sandwich structures for a number of reasons, including the adaptability of the alloy to diffusion bonding.

Since sandwich structures consist of a number of workpieces, the workpieces must be joined together to form a finished structure. The term "joining" as used herein refers to any method of attaching two workpieces together. The joining can be accomplished by brazing, welding, bonding, or by applying adhesives. "Welding" processes include cold welding, fusion welding, pressure welding, and laser welding, and involve the metallurgical joining of the surfaces by applying heat, causing the materials at the joint interface to reach a liquid or plastic state and merge into a unified whole. "Bonding" processes include diffusion bonding, deformation bonding, and solid state bonding and involve metallurgical bonding wherein the material in the bond is similar in composition and state to the surrounding material. "Diffusion bonding" as used herein refers to the solid state joining of similar or dissimilar metals by applying heat and pressure for a time duration to cause commingling of the atoms at the joint interface.

Since temperature and differential pressure ranges for superplastic forming and diffusion bonding are similar in many applications, the processes may be used together in what is essentially a one-step operation. However, a disadvantage of superplastic forming is that it requires the use of superplastic materials raised to superplastic forming temperatures and pressures.

U.S. Pat. No. 4,361,262 entitled "Method of Making Expanded Sandwich Structures" to L. Israeli, which is incorporated by reference into this specification, discloses a process that may be used as a substitute for superplastic forming. The process is called "accordion expansion" and essentially involves the unfolding of core sheets with a minimal amount of expanding. The formed sandwich structures generally have a vertical core that is linear and flat, although angled core is also possible. To form such structures only about 10% expansion is required. Since almost all metals will expand 10% without a significant loss of strength at elevated temperatures, accordion expansion is not limited to superplastic materials.

Oftentimes, sandwich structures having flat core do not provide sufficient strength to normal loads. It has been estimated that sandwich structures having a sine wave core configuration are about 150% stronger than such structures having a flat core. In addition, other curved core configurations can be used in specific applications where linear core is inadequate. A major advantage of accordion expansion is that forming can occur at temperatures and pressure differentials significantly lower than superplastic forming. Clearly, what is needed is a method of making stronger sandwich structure configurations that is not limited to superplastic materials.

SUMMARY

It is the principal object of the present invention to form metallic sandwich structures having improved strength and substantially curved cores by unfolding and expanding workpieces that are initially flat.

It is another object of the present invention to form a multiplicity of sine wave I-beams simultaneously from several initially flat face sheets.

The present invention involves metallic sandwich structures having curved core. As used herein the term "curved" refers to a rounded core sheet, which is not bowed or buckled relative to the face sheets. Preferably, the curvature is such that (1) a first plane that is perpendicular to either face sheet, intersects the core and forms linear sections, and (2) a second plane parallel to either face sheet, intersects the core, and forms rounded core sections substantially identical in shape to all sections, formed by other parallel planes.

The lip portions are the parts of the core pieces where all of the joining to other workpieces occurs. Prior to forming the lip portions are extensions of the flat core pieces and are indistinguishable from the rest of the core pieces. During and after forming the lip portions are generally bent at an angle relative to the body of the core piece, and the core pieces deform to be in linear alignment with the adjacent edge of the lip portion.

The forming method generally involves two face pieces and two core pieces. The shape of the preformed core pieces are cutout and substantially identical to each other, both being curved in a shape similar to the shape to be formed. The shape of the lip portions prior to forming are curved and do not change during forming. All joining of the workpieces occurs at the lip portions. Generally, the joining occurs prior to the forming stage.

The four pieces are placed in a stack, with the core pieces positioned between the face pieces. The core pieces each have two lip portions. One set of lip portions joins the core pieces to each other, whereas the other lip portions join the core pieces to the face pieces. The joining usually is a metallurgical bonding process and diffusion bonding is preferred.

The shape of the core after forming is determined by the shape of the preformed core pieces, the shape of the lip portions, and the amount of stretching permitted by the materials used at the forming temperatures and forming pressures.

After the pieces are joined together, heat and a differential pressure are applied to form a sandwich structure with a curved core. The process can be used to form sine wave I-beams, a sandwich structure having several sine wave core shapes supporting the face sheets, or other sandwich structure having a curved core. The method involves unfolding, and some stretching estimated to be less than 30% at the curved portions having gradual bends, and less than 10% at the straight portions. For curved portions having more radical bends, more stretching may be required. The materials may be metals or plastics that can withstand such stretching with a minimal loss in strength, although the process is directed at metals. It is estimated that accordion expansion using flat sheets for 6Al-4V titanium may occur at temperatures of about 1250° F. When curved core is involved, higher forming temperatures are needed to accommodate the increased stretching, which approach superplastic forming temperatures.

The sandwich structures formed by this process are characterized by at least a two piece curved core that is joined together along a common lip portion, and the core pieces are joined to said face pieces by other lip portions. Also, several sandwich beams can be formed simultaneously by severing the face pieces after the forming process.

The novel features which are believed to be characteristic of the invention, both as to its structure and its method of forming, together with further objects and advantages thereof, will be better understood from the following description in connection with the accompanying drawings in which presently preferred embodiments of the invention are illustrated by way of examples. It is to be expressly understood, however, that the drawings are for purposes of illustration and description only, and are not intended as a definition of the limits of the invention.

DETAILED DESCRIPTION OF THE INVENTION

All of the drawings used herein are exaggerated for purposes of illustration. The sheets will ordinarily range in thickness from 0.03 inches to 0.25 inches. In all of these embodiments diffusion bonding is the joining method. In diffusion bonding, a surface to be joined to a surface on an adjacent sheet is coated at selected areas with a stopoff material, such as yttria ($Y_2O_3$), to control precisely the areas to be joined.

Figure 1A:
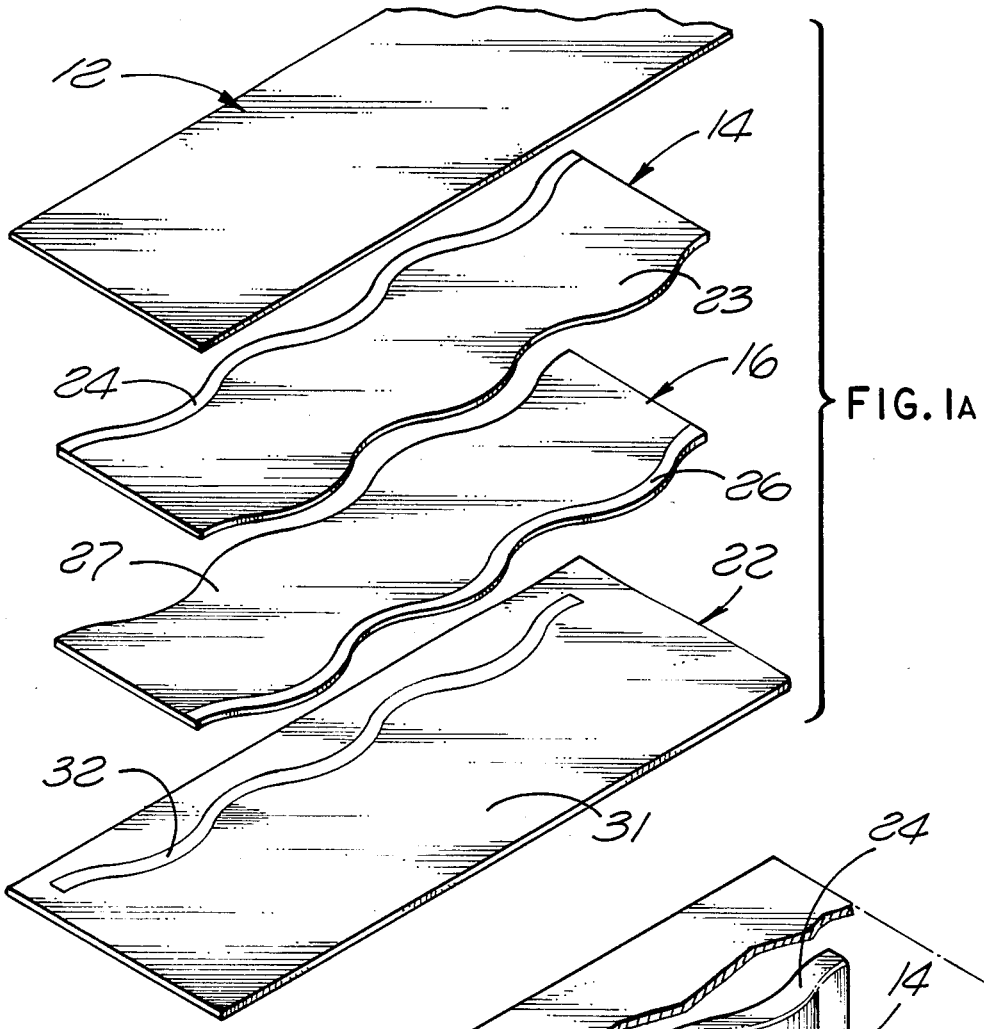
FIG. 1A is an isometric view showing four layers of a sandwich structure prior to assembly that will form one sine wave I-beam.
Figure 1B:
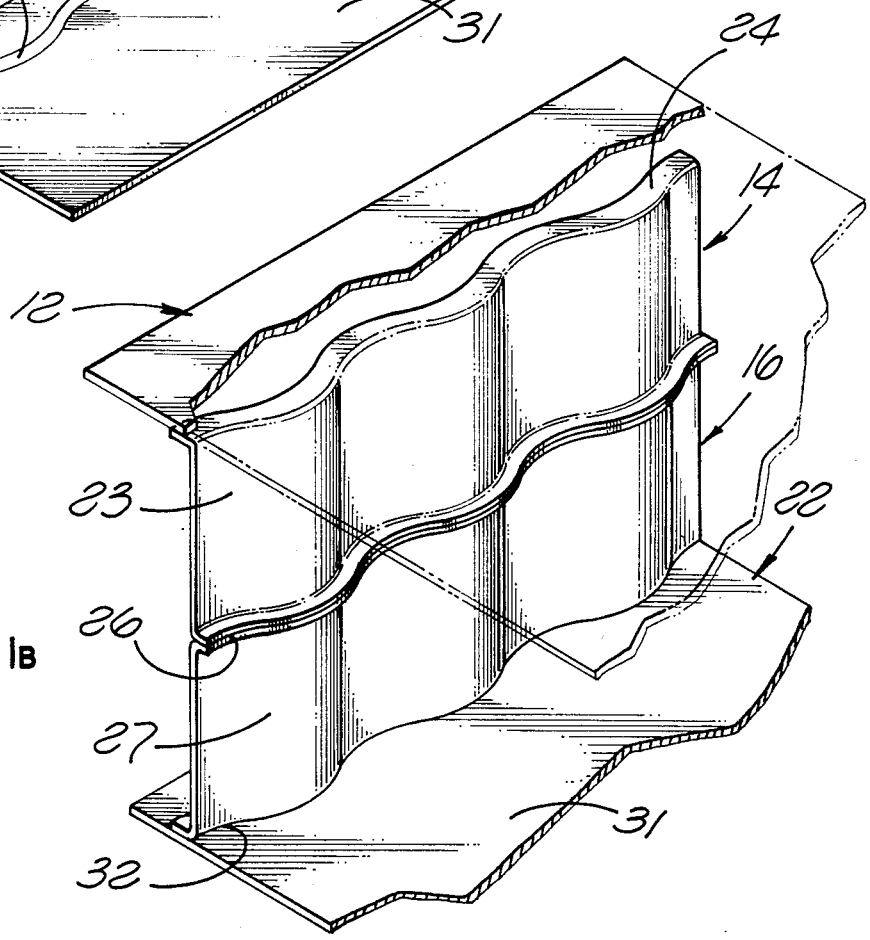
FIG. 1B is an isometric view of the sandwich structure shown in FIG. 1A, after forming.

Referring now to FIGS. 1A and 1B, a sine wave sandwich structure having four flat sheets is shown. Although the angle of the sine wave may vary between about 100 to 180 degrees, a 120 degree angle is shown and is preferred to maximize strength against buckling without involving extreme stretching of the material. FIG. 1A shows the structure prior to forming, and FIG. 1B shows the structure after forming.

FIG. 1A depicts flat core sheets 14 and 16 positioned between face sheets 12 and 22. Area 23 of sheet 14, area 27 of sheet 16, and area 31 of sheet 22 are covered with a stopoff material to prevent bonding to the surface directly above them.

Lip portions are longitudinal portions of the core sheets and are not coated with the stop-off material. All joining of the sheets occurs along the lip portions. Lip portion 24 of core sheet 14 is diffusion bonded to the bottom surface of face sheet 12. Lip portion 26 of core sheet 16 is diffusion bonded to the bottom surface of core sheet 14. A lip portion on the bottom of core sheet 16 (not shown) is diffusion bonded to area 32 of face sheet 22.

Figure 2:
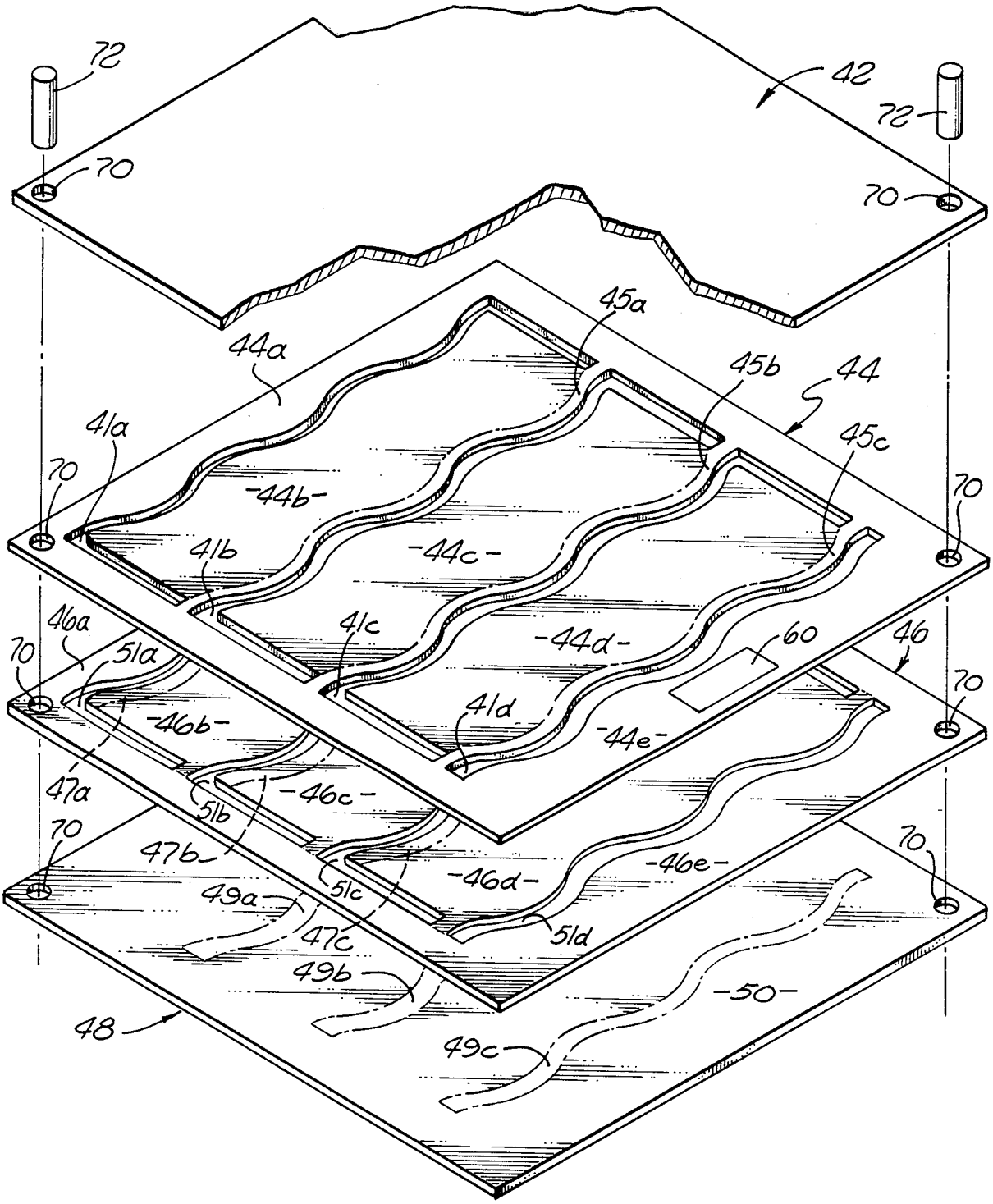
FIG. 2 is an exploded isometric view having a fragmentary upper face piece of a preformed sandwich structure having three sine wave I-beams.
Figure 3:
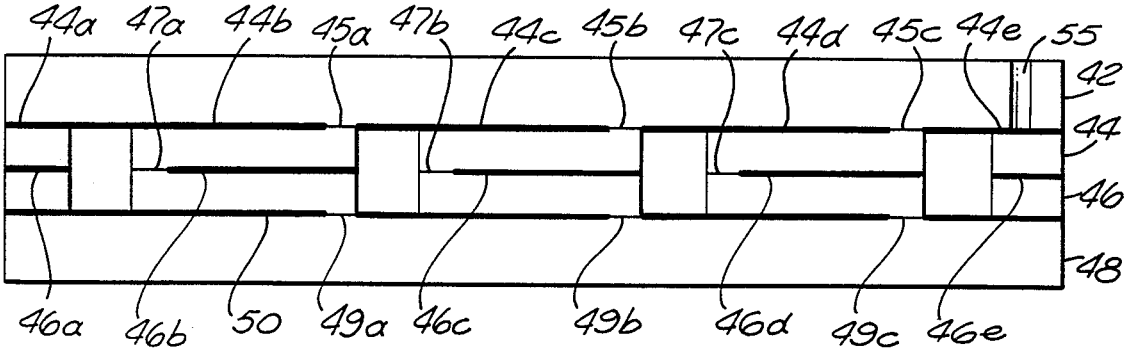
FIG. 3 is a sectional view of the assembled, preformed sandwich structure shown in FIG. 2, along with the required tooling.

Referring now to FIGS. 2 and 3, a configuration for forming a series of three sine wave I-beam sandwich structures is shown. FIG. 2 shows the stopoff patterns prior to assembly and forming, and FIG. 3 shows a sectional view of the four sheets assembled but prior to forming along with the necessary tooling.

FIG. 2 is similar to FIG. 1A, in that both drawings depict a preassembled and preformed configuration for making a sine wave I-beam sandwich structure. The FIG. 1A configuration will make one beam, whereas the FIG. 2 configuration will make three beams. After the FIG. 2 configuration is diffusion bonded and formed, face sheets 42 and 48 are severed along the longitudinal axis to form the three sine wave I-beams, similar to the one shown in FIG. 1B.

In order to insure that the stack of sheets remain aligned during forming, sheets 42, 44, 46, and 48 are each provided with alignment holes 70 at opposite corners. Pins 72 are inserted into holes 70 of each sheet. Core piece 44 has curved cutout portions 41*a*, 41*b*, 41*c*, and 41*d*, and core piece 46 has curved cutout portions 51*a*, 51*b*, 51*c*, and 51*d*, which determine the shape of the curved core structure after forming. Core piece 44 has stopoff material applied at areas 44*a*, 44*b*, 44*c*, 44*d*, and 44*e*. Core piece 46 has stopoff material applied at areas 46*a*, 46*b*, 46*c*, 46*d*, and 46*e*. Face piece 48 has stopoff material applied at area 50. Core piece 44 has lip portions 45*a*, 45*b*, and 45*c*, which will all be diffusion bonded to face piece 42. The stopoff material may be applied at the bottom surface of the top sheet, the top surface of the bottom sheet, or along both surfaces. For illustration purposes the stopoff pattern is shown over the top surface of each sheet. Core piece 46 has lip portions 47*a*, 47*b*, and 47*c* which will be diffusion bonded to the bottom surface of core piece 44. Face piece 48 has areas 49*a*, 49*b*, and 49*c* which will be diffusion bonded to the lower surface of core piece 46. Stopoff path 60 is used to allow inert gas to flow into the stack during forming. Aperture 55 provides a passageway for the inert gas to pass through face piece 42. By virtue of the curved shape of the bonded lip portions (e.g.—14 and 26) the unbonded portions of the core sheets are stretched as they are unfolded, so as to be in linear alignment with the bond.

Figure 4:
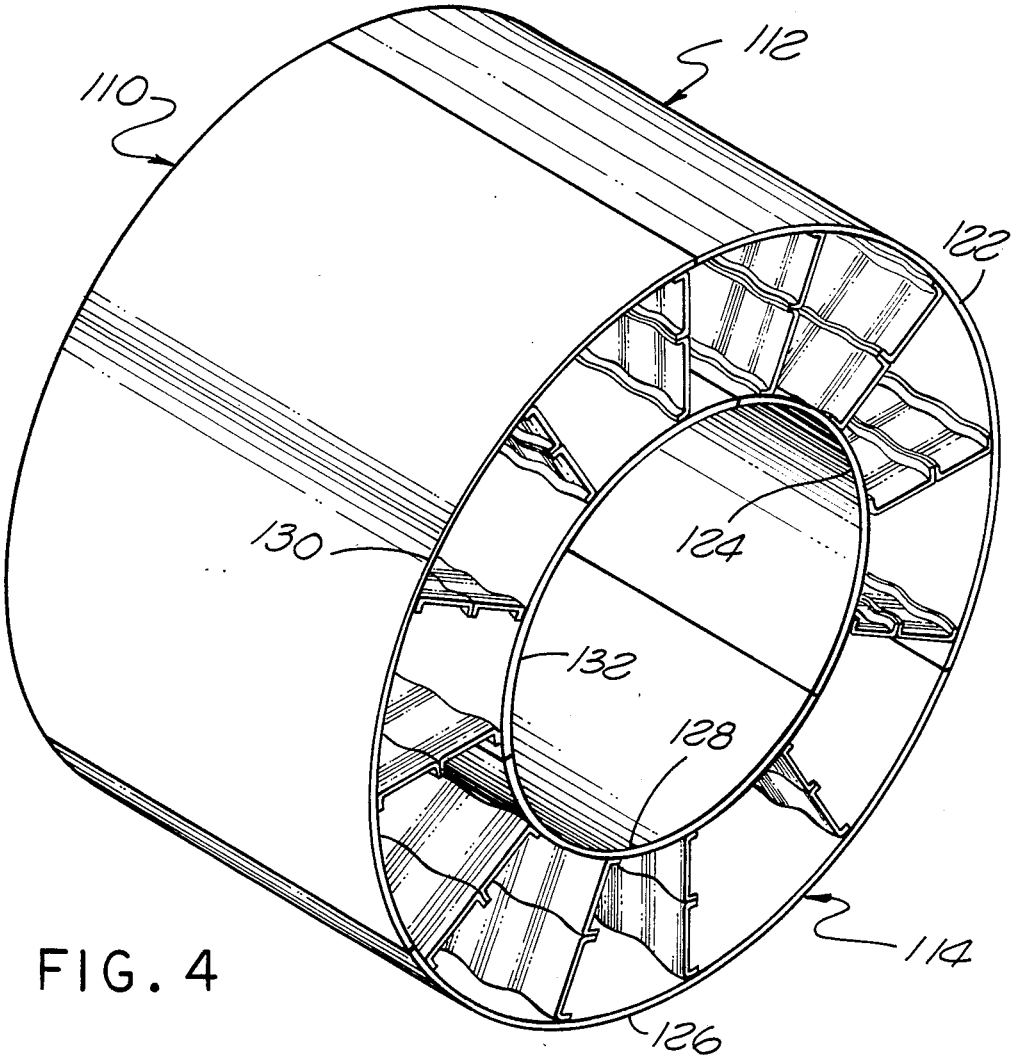
FIG. 4 is an isometric view of three formed sandwich structures prior to assembly, each having concentric but parallel face sheets, and each having a plurality of curved core members.

Referring now to FIG. 4, another embodiment of the present invention is shown. The embodiment involves joining three formed sandwich structures 110, 112, and 114, each of which are joined together to form a hollow cylindrical sandwich structure having sine wave I-beams for support. Structure 110 has parallel and concentric face pieces 130 and 132; structure 112 has parallel and concentric face pieces 122 and 124; and structure 114 has parallel and concentric face pieces 126 and 128.

Figure 5A:
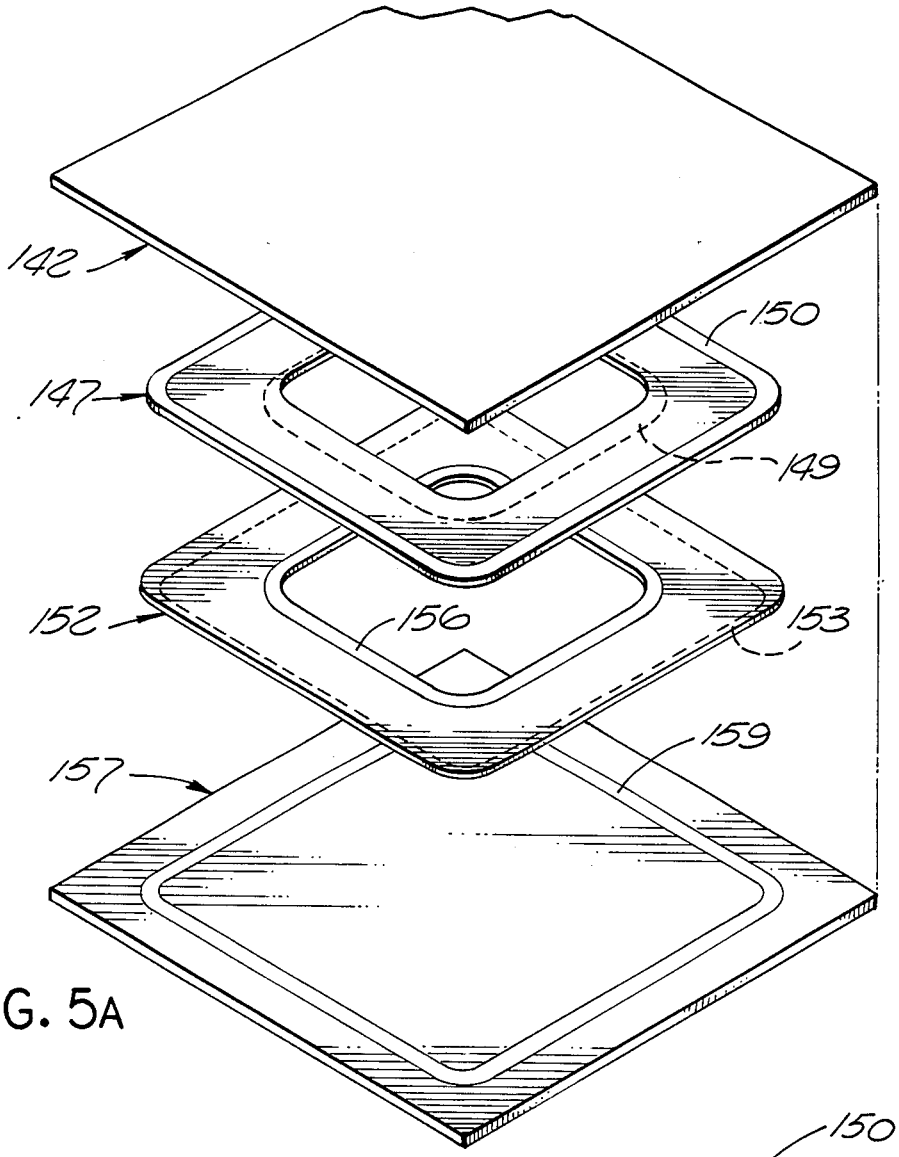
FIG. 5A is an isometric view showing four layers of a preformed picture frame sandwich structure.
Figure 5B:
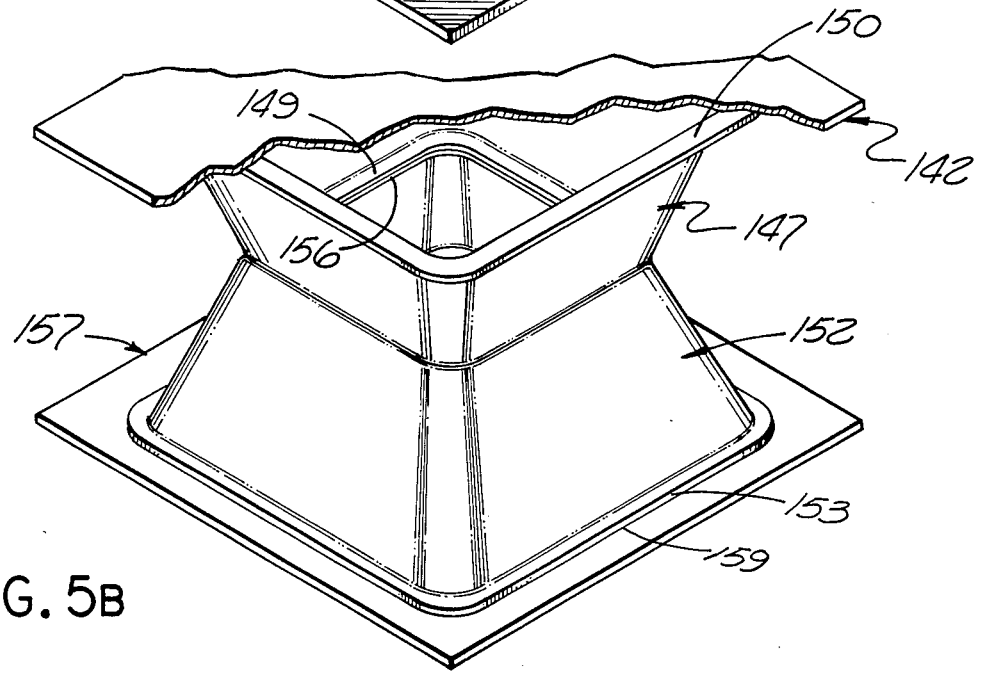
FIG. 5B is an isometric view having a fragmentary upper face piece of the formed picture frame sandwich structure shown in FIG. 5A.

Referring now to FIGS. 5A and 5B, still another embodiment of the present invention is shown of a sandwich structure having a closed and curved core. FIG. 5A shows the four piece stack prior to forming with face pieces 142 and 157 and core pieces 147 and 152. Core pieces 147 and 152 each have a cutout portion therein. Joining is by diffusion bonding. The areas not to be bonded are coated with stop-off material (e.g.—148, 154). Lip portion 150, which is on the upper surface of core sheet 147, is bonded to the lower surface of face sheet 142. Lip portion 149, which is on the lower surface of core sheet 147, is bonded to lip portion 156, which is on the upper surface of core sheet 152. Lip portion 153, which is on the lower surface of core sheet 152, is bonded to area 159 on the upper surface of face sheet 157. After the lip portions are bonded together, a differential pressure is applied between the interior and the exterior of the stack and the structure shown in FIG. 5B is formed. To expand the structure so that the walls are vertical, vertical forming members (not shown) may be applied to the partially formed wall surfaces.

FIG. 5B shows the same structure as shown in FIG. 5A, but after the sandwich structure has been formed. Face piece 142 is broken away to better depict the inside of the finished sandwich structure. The structure is in the shape of a closed core sandwich structure.

It is estimated that the unfolding involved in making flat core portion 160, results in material stretching of less than 10% whereas in the rounded core portions 162, the material stretching is generally less than 30%, depending upon the amount of curvature involved. This amount of material stretching can be accommodated by superplastic materials or nonsuperplastic materials, when exposed to sufficient temperatures and pressure differentials. To fabricate structures having excessive amounts of curvature, superplastic materials may be required, or alloys such as 15-3-3-3 titanium or 6-6-2 titanium which are marginally superplastic (alloys have some necking), since these materials can accommodate more stretching. Also, as more stretching is required the temperatures involved approach the superplastic forming temperature of the material.

When the sheets are inserted into a stack in any of the embodiments of the present invention, it is important to maintain small passageways to the interior of the stack. The passageways are connected to a pressurized gas system during the expansion step. Inert gas, preferably argon, is used for reactive metal structures.

The stack can be heated to a suitable diffusion bonding temperature (about 1700° F. for Ti-6Al-4V) by heat generated from heating platens (not shown). Pressure is applied to the stack to effect the bonding. After the bonding has been completed, pressurized gas (from 100 to 500 psi for up to 15 minutes) is inserted and circulated through the passageways and the stack. The applied pressure will force the stack to inflate and fill the die cavity with the face sheets, against the upper and lower die surfaces respectively. The accordion expansion temperature range for 6Al-4V titanium is from 1250° F. to 1700° F.

Accordingly, there has been provided, in accordance with the invention, curved core sandwich structures and a forming method that fully satisfies the objectives set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

I claim:

1. A method for forming a metallic sandwich structure having a substantially curved core portion from a plurality of flat workpieces, which comprises:

providing two face pieces, each having two opposed principal surfaces;

providing first and second core pieces, each having two opposed principal surfaces, each of said core pieces having a first lip portion along a longitudinal edge and a second lip portion along the opposite longitudinal edge each of said lip portions having a substantial portion thereof which is curved, and each of said core pieces having a substantially identical shape as said other core piece;

positioning said face pieces and said core pieces in a stack, contacting at their principal surfaces, such that said two face pieces sandwich said two core pieces;

joining said core pieces to each other along said first lip portions and to said face pieces along said second lip portions; and raising the temperature of said stack to a forming temperature, and;

applying a differential pressure between the interior and exterior of said stack such that said stack is expanded and said core pieces are formed into a curved core made up of said first and second core pieces.

2. The method of claim 1 wherein said joining is by metallurgical bonding.

3. The method of claim 2, further comprising selectively applying a stopoff material to said principal surfaces of said pieces on those areas not to be joined, prior to said bonding, and said bonding is diffusion bonded.

4. The method of claim 1, wherein at least one of said face pieces and both of said core pieces are superplastic.

5. The method of claim 4, wherein said forming temperature is the superplastic forming temperature of said workpieces.

6. The method of claim 1, wherein each of said core pieces are sheets having a plurality of cutout portions therein, said cutout portions on each of said sheets being similar to said cutout portions on each other core sheet, and said two core sheets with cutout portions form one sandwich structure with a plurality of cores and each core having substantial curvature.

7. The method of claim 6, further comprising severing said face sheets to form a plurality of sandwich structures each having one core section with substantial curvature.

8. The method of claim 1, where the shape of each of said lip portions prior to forming is substantially identical to the shape of the same lip portion after forming.

* * * * *